US011050163B2

(12) United States Patent
Glogowski

(10) Patent No.: US 11,050,163 B2
(45) Date of Patent: Jun. 29, 2021

(54) ARRAY ANTENNA

(71) Applicant: HUBER+SUHNER AG, Herisau (CH)

(72) Inventor: Rafal Glogowski, Wiazowna (PL)

(73) Assignee: HUBER+SUHNER AG, Herisau (CH)

( * ) Notice: Subject to any disclaimer, the term of this patent is extended or adjusted under 35 U.S.C. 154(b) by 153 days.

(21) Appl. No.: 16/311,098

(22) PCT Filed: Jun. 26, 2017

(86) PCT No.: PCT/EP2017/065620
§ 371 (c)(1),
(2) Date: Dec. 18, 2018

(87) PCT Pub. No.: WO2018/001921
PCT Pub. Date: Jan. 4, 2018

(65) Prior Publication Data

US 2020/0313304 A1 Oct. 1, 2020

(30) Foreign Application Priority Data

Jun. 29, 2016 (CH) ..... 825/16

(51) Int. Cl.
*H01Q 1/52* (2006.01)
*H01Q 21/06* (2006.01)

(52) U.S. Cl.
CPC ..... *H01Q 21/064* (2013.01)

(58) Field of Classification Search
CPC .. H01Q 1/523; H01Q 21/0043; H01Q 21/005; H01Q 21/06; H01Q 21/061; H01Q 21/064
See application file for complete search history.

(56) References Cited

U.S. PATENT DOCUMENTS

| | | | | |
|---|---|---|---|---|
| 4,219,820 | A | 8/1980 | Crail | |
| 8,467,737 | B2 * | 6/2013 | Choudhury | H01L 23/552 455/73 |
| 9,543,643 | B2 * | 1/2017 | Hayakawa | H01Q 1/3233 |
| 10,498,000 | B2 * | 12/2019 | Hadavy | B21K 23/00 |
| 2014/0340271 | A1 | 11/2014 | Petkov et al. | |

FOREIGN PATENT DOCUMENTS

| | | | | |
|---|---|---|---|---|
| WO | WO-9639730 | A1 * | 12/1996 | H01Q 13/18 |
| WO | WO 02/078125 | A1 | 10/2002 | |
| WO | WO 2015/042953 | A1 | 4/2015 | |
| WO | WO 2015/172948 | A2 | 11/2015 | |

* cited by examiner

*Primary Examiner* — Dimary S Lopez Cruz
*Assistant Examiner* — Patrick R Holecek
(74) *Attorney, Agent, or Firm* — Pauley Erickson & Swanson

(57) ABSTRACT

Disclosed is an antenna, in particular array antenna. The antenna includes an antenna top surface (1*a*) and an antenna bottom surface (1*b*). The antenna further includes a waveguide channel structure with a plurality of waveguide end branches (111). Each waveguide end branch (111) opens into an associated waveguide opening (100) in the antenna top surface (1*a*) in a one-to-one relation, wherein the waveguide openings (100) are arranged in a pattern of rows and columns. A plurality of recesses (101) extends from the antenna top surface (1*a*) towards the antenna bottom surface (1*b*), the plurality of recesses (101, 101*b*) being arranged such that a recess (101*b*) is present between pairs of neighboring waveguide openings (100) of the same row and/or column.

14 Claims, 7 Drawing Sheets

ARRAY ANTENNA

BACKGROUND OF THE INVENTION

Field of the Invention

The present invention lies in the field of high-frequency and waveguide technology. More particularly, it lies in the field of array antennas with reduced mutual coupling.

Discussion of Related Art

In the field of millimetre-wave electronics, it is generally known to use waveguides rather than wired or galvanic connections. Waveguide antennas are known for transmitting and receiving radiofrequency (RF) signals in the Giga-Hertz (GHz) range and a variety of designs is known. In the following, so called array antennas with an arrangement of a plurality of waveguide elements (waveguide openings) for transmitting and/or receiving RF signals are considered. Also for those antennas, a variety of designs is known.

For array antennas, mutual coupling between antenna array elements is a well know phenomenon that leads to degradation of RF performance. Due to mutual coupling, the isolation between antenna array ports is reduced and this results in scan blindness, increase of cross-polarization, and higher return loss.

The most common way to increase the isolation between active elements (waveguide openings) is to increase the distance between them. However, this countermeasure is limited since it influences also other parameters, like e.g. directivity, which one would like to have under control, and could lead to "grating lobes phenomena", which should be avoided in the sake of RF performance of the array.

U.S. Pat. No. 4,219,820A suggests minimizing mutual coupling by placing a thin dielectric sheet on the waveguide outputs with some printed metallization strips which reduce the mutual coupling which results in lower cross-polarization. From the point of view of the general RF performance this solution results in additional losses due to the use a dielectric sheet and some metallic elements in front of the radiator opening where the electric field is the strongest. It can also perturb the radiation patterns.

US2014340271A1 suggests minimizing mutual coupling by shaping the outer surface of the antenna array horns. The horns are separate entities and there is free space between them. This solution requires complicated fabrication since each horn is a separate body and also requires some solution to mount and align them together.

WO2015/172948A2 suggests an antenna where channels are arranged between the waveguide outputs. The waveguide outputs couple to a common space with a plurality of protruding posts or fingers inside the antenna.

SUMMARY OF THE INVENTION

It is an overall objective of the present invention to improve the state of the art regarding mutual coupling. Favourably an antenna with reduced mutual coupling is compact and can be manufactured in a cost efficient way.

The overall objective is achieved by the subject matter of the independent claims. Particularly favourable as well as general exemplary embodiments are defined by the subject matter of the dependent claims as well as the overall disclosure of the present documents. Particular advantages of the invention in general as well as of particular embodiments are discussed further below in context of the overall description.

In an aspect, the overall objective is achieved by providing an antenna, in particular an array antenna. The antenna includes an antenna top surface and an antenna bottom surface. The antenna further includes a waveguide channel structure with a plurality of waveguide end branches. Each of the plurality of waveguide end branches opens into an associated waveguide opening in the top surface in a one-to-one relation. The waveguide openings are arranged in a pattern of rows and columns. A plurality of recesses extends from the antenna top surface towards the antenna bottom surface, the plurality of recesses being arranged such that a recess is present between pairs of neighbouring waveguide openings of the same row and/or column.

The waveguide end branches are end sections of the waveguide channel structure. Due to the one-to-one relation between waveguide end branches and waveguide openings, the number of waveguide openings corresponds to the number of waveguide end branches.

The top surface is typically flat or planar. An extension of the recesses traverse to the top surface is referred to as depth. In particular embodiments that are discussed further below in more detail, the top surface and the bottom surface are coplanar respectively parallel to each other.

The waveguide openings serve for electromagnetic, in particular radiofrequency, coupling of the antenna with the environment. Via the waveguide openings, radiofrequency signals are transmitted and/or received in operation. For this purpose, the waveguide channel structure typically includes a horn-shaped waveguide channel section associated with each waveguide end branch. The horn-shaped waveguide channel sections open into the antenna top surface, thereby forming the waveguide openings.

The waveguide openings are arranged in an m×n-Matrix, with m being the number of rows and n being the number of columns.

Without the recesses that are present in accordance with the present disclosure, the waveguide openings as radiating elements when radiating radiofrequency (RF) energy, excite currents on the metallic surface of the antenna, in particular in-between the waveguide openings. These currents contribute to galvanic mutual coupling between the waveguide elements. In accordance with the present disclosure a galvanic "short" at the bottom or ground of the recesses is transformed into a galvanic "open" at the top surface by the means of transmission line impedance transformation. In this way, the before-mentioned excited currents are avoided or at least significantly reduced, thereby reducing the mutual coupling. The same applies, in an analogue way, if RF energy is received by the antenna.

In an embodiment, the recesses are elongated channels that extend traverse to the rows and/or columns.

For an embodiment where channels extend traverse to the rows only, the channels extend parallel to and between the columns. The channels are, like the waveguide openings, open to the top surface and extend towards the bottom surface. Each channel extends over a number of rows and typically over all rows. For this type of embodiment, (n−1) channels are accordingly present for the n columns. The channels generally extend along a straight line and have a channel length l. The channel dimension in the top surface or parallel to the top surface traverse to the longitudinal extension or length of the channels and traverse to the channel depth is referred to as channel width. The channels may also be referred to as "grooves" or "slots".

Similarly, for an embodiment where the channels extend traverse to the columns only, the channels are arranged parallel to and between the rows. For this type of embodiment, (m−1) channels are accordingly present for the m rows.

For a further type of embodiments, channels extend parallel to and between both the rows and columns. Here, a channel extends parallel to and between each pair of neighbouring columns and each pair of neighbouring rows. For the m rows of waveguide openings (m−1) channels are accordingly present between the rows. Likewise, for the n columns of waveguide openings, (n−1) are accordingly present between the columns. In total, (m−1)+(n−1) channels are accordingly present for this type of embodiment.

For the sake of conciseness, the following description mainly refers to embodiments where channels extend traverse the rows, parallel to and between the columns.

In an embodiment with the recesses being channels, the channels extend beyond the outermost rows and/or columns. With potentially somewhat lower performance the channels may also be ended flush with the outer edges of the outermost rows respectively columns. The outermost rows are the rows 1 and m. The outermost columns are referred to as columns 1 and n.

In an embodiment with the recesses being elongated channels, a cross section of the channels is substantially rectangular, with the width being typically slightly wider at the top surface than at the ground for manufacturing reasons. For manufacturing reasons in particular by injection moulding, the aspect ratio of the cannels is typically chosen to be 2:1 or smaller, i. e. the channel depth being no more than double of the channel width.

In an embodiment with the recesses being elongated channels, the channel width and the channel depth are constant over the whole channel length.

In a further embodiment with the recesses being elongated channels, the channel depth of a channel depth varies, in particular varies periodically, along the channel length. The channel width may be constant or vary over the channel length.

In a further embodiment with the recesses being elongated channels, a channel width of varies, in particular varies periodically, along the channel length. The channel depth may be constant over the channel length.

In an embodiment, a separate recess is provided in each row between neighbouring columns and/or in each column between neighbouring rows. For this type of embodiment, the recesses do not have the shape of elongated channels, but are depressions that are isolated with respect to each other. In this embodiment, the recesses are, like the waveguide channels, arranged in a matrix and between the waveguide channels. For the m rows and n columns of the waveguide openings, recesses may be arranged in an in X (n−1) matrix. In each row, the n−1 recesses are favorably centered respectively aligned with the waveguide openings of this row. Alternatively or additionally, recesses may be arranged in an (m−1) X n matrix and in each column, the (m−1) recesses are favorably centered respectively aligned with the waveguide openings of this column.

In an embodiment, a recess depth is between ⅛ and ⅜ of the wavelength in an operational frequency range of the antenna. For a single frequency, a recess depth of ¼ of the wavelength is considered ideal from a theoretical point of view. For practical purposes and an antenna that is designed for a frequency range rather than a single frequency, the above-given range is generally appropriate. A typical and exemplary frequency range is 57 GHz to 66 GHz.

In an embodiment, the waveguide channel structure opens into a plurality of waveguide terminal openings in the antenna bottom surface and the waveguide channel structure extends between the antenna top surface and the antenna bottom surface. The waveguide channel structure coupes the waveguide openings and the waveguide terminal openings. The waveguide terminal openings serve for coupling the antenna to an RF circuit that is, e. g. arranged on a printed circuit board and/or has a waveguide input/output.

The waveguide channels of the waveguide channel structure may be partly or fully ridged, i.e. in the form of Single Ridge Waveguide or Double Ridge Waveguide, in order to achieve the desired RF characteristics in the operational frequency range of the antenna, and in particular good impedance matching with other components such as a waveguide structure of a printed circuit board (PCB). In a particular embodiment, the waveguide channels of the waveguide channel structure are double-ridged in a section that opens into the waveguide terminal openings, resulting in the waveguide terminal openings also being double-ridged.

In an embodiment, the number of waveguide terminal openings corresponds to the number of rows and the waveguide channel structure couples each waveguide terminal opening with all waveguide openings of a corresponding row and independent from the other rows. For a typical embodiment, the waveguide terminal openings are arranged along a straight line respectively column, parallel to the columns of waveguide openings. The coupling being independent for the single rows especially means that no coupling is present via the waveguide channel structure. Due to the arrangement in accordance with the present disclosure, the inherent electromagnetic coupling of the waveguide openings within each row is avoided or at least substantially reduced. For this type of embodiment, a radiofrequency signal that is feed into a specific waveguide terminal opening is accordingly distributed to all waveguide openings of the corresponding row. Similarly, if the antenna operates as receiving antenna, an electromagnetic signal may be collected from all waveguide openings of a row and feed to the corresponding waveguide terminal opening.

In some typical antenna designs, no space is present for providing recesses in-between waveguide openings belonging to neighbouring rows and the same column. This results from the requirement to provide vertical polarization of the radiated/received signal which results in the waveguide openings being wider in the column direction as compared to the row direction. A further typical requirement that does not allow providing recesses in-between waveguide openings belonging to neighbouring rows and the same column is the enabling of beam scanning capabilities which limits the possible distance between the rows due to the need to avoid "grating lobes phenomena". In another embodiment, however, recesses may be arranged between pairs of waveguide openings belonging to neighbouring rows and the same column.

In a typical embodiment, the waveguide channel structure is designed such that a signal that is fed into a waveguide terminal opening reaches all waveguide openings of the corresponding row with a common relative phase. The signal propagation time is accordingly equal between a waveguide terminal opening and the associated waveguide openings of the corresponding row. In a typical embodiment, the waveguide channel structure is further designed in the same way for the different rows.

In an embodiment, the antenna is made from stacked coplanar layers. The antenna top surface belongs to a top layer and the antenna bottom surface belongs to the bottom layer. One or more intermediate layers may be sandwiched between the top layer and the bottom layer and comprise a coupling channel structure that serves for waveguide coupling between the waveguide openings and the waveguide terminal openings, e. g. in the before-described way. Typically, all layers are of the same lateral dimensions (perpendicular to the stacking direction) and aligned with each other, resulting in an overall cuboid or cube shape of the antenna.

In an embodiment, the antenna is made from metal and/or metalized plastics and/or conductive plastics. For an embodiment where the antenna is made of a number of stacked layers as explained before, the individual layers may be made from metal, e. g. brass and/or metalized plastic. The plastic is generally metallic coated on all surfaces, in particular all functionally relevant surfaces. These functionally relevant surfaces particularly include the top and bottom surfaces of the individual layers, at least in the area of the waveguide channel structure, and the inner surfaces of the waveguide channel structure within the plastic. The metallization also includes the side walls and ground of the recesses, e.g. channels, thereby ensuring a conductive coupling in particular of the recesses ground. The metallization is a achieved by metal coating or metal plating as generally known in the art, thereby creating a continuous conductive layer on the originally non-conductive plastics. In embodiments where the antenna is fully or partly made from metal, machining may be used for generating the required structures, in particular waveguide structures. Using metal instead of plastics may be favourable e. g. in small series and testing equipment applications. Alternatively or additionally to metal and metalized plastics, conductive plastics, in particular conductive plastics based on carbon fibre composites, may be used.

According to a further aspect, the overall objective is achieved by a further antenna. This type of antenna includes an antenna top surface and a waveguide channel structure that opens into a plurality of waveguide openings in the antenna top surface. The waveguide openings are arranged in a pattern of rows and columns, wherein the antenna includes a top layer with the antenna top surface belonging to the top layer. The top layer is made from partially metallized non-conductive material, wherein a non-metalized area is present on the antenna top surface between neighbouring waveguide openings of the same row and/or column.

For the before-described type of antenna, the goal of avoiding/reducing the mutual coupling is achieved by a galvanic "short" at the ground of the recesses, that is transformed into a galvanic "open" at the top surface, as explained before. For the here-described further antenna, a similar effect is achieved by providing non-conductive areas between neighbouring waveguide openings, thereby reducing the mutual galvanic coupling by eliminating direct surface currents between waveguide openings, thereby also avoiding respectively reducing mutual galvanic coupling.

According to an embodiment of this type of antenna, the top surface is metalized in an area around the waveguide openings and a plurality of non-metalized stripes is present on the antenna top surface such that a non-metalized strip extends between neighbouring rows and/or columns. The non-metallized stripes are arranged in substantially the same way as the channels of a before-described type of embodiment, extending parallel to and between the columns. The non-metalized stripes may be achieved by sparing the corresponding strip-shaped surface areas when metalizing the surface or by first completely metalizing the surface and subsequently removing the metallization in the strip-shaped areas where the metallization is undesired. The non-metalized stripes may be arranged in the same way as the elongated channels of before-described embodiments.

According to another embodiment of this type of antenna, the antenna top surface is non-metalized over the whole area that is covered by the waveguide openings. In particular, the antenna top surface may be fully non-metallized. However, the waveguide openings remain metallised in order to radiate or receive high-frequency signals.

According to a further aspect, the overall objective is achieved by the use of an antenna as explained before and/or further below for transmitting and/or receiving a radio frequency electromagnetic signal.

Equivalently, the overall objective is achieved by a method for transmitting and/or receiving a radiofrequency electromagnetic signal, the method including transmitting and/or receiving the RF signal via an antenna is explained before and/or further below.

DETAILED DESCRIPTION OF THE INVENTION

In the following description of exemplary embodiments, directional terms such as "top", "bottom", "left", "right", are referred to with respect to the viewing directions according to the drawings and are only given to improve the reader's understanding. They do not refer to any particular directions or orientations in use. Furthermore, a plane that is span by the x-y directions of the shown coordinate systems (normal to the z-direction) is referred to as "lateral". The term "footprint" is used with reference to the z-direction as viewing direction.

Figure 1:
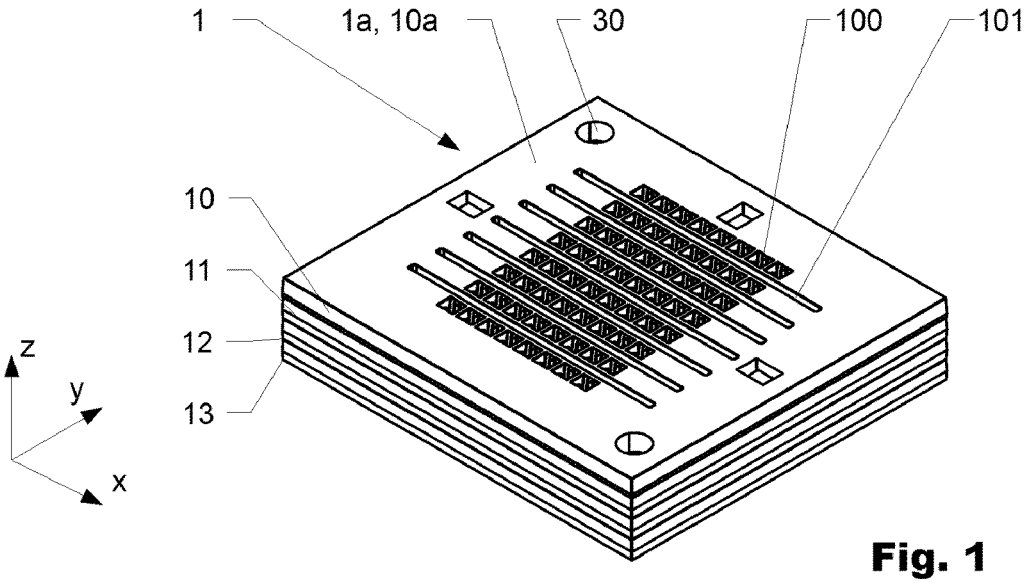
FIG. 1 shows an exemplary array antenna in a schematic perspective view.

In the following, reference is first made to FIG. 1, showing an exemplary array antenna 1 in accordance with the present invention in a perspective view.

By way of example, the antenna 1 is itself realized by a stack of four coplanar layers 10, 11, 12, 13. Further by way of example, all layers 10, 11, 12, 13 have identical rectangular footprints and are arranged in a congruent way one above the other in the z-direction, with the layer surfaces extending normal to the z-direction. Layer 13 is the bottom layer and layer 10 is the top layer. The layers 10, 11, 12, 13 are exemplarily realized by injection moulded plastics and metallized on all relevant surfaces. That is, the top and bottom surfaces are metallized at least in the area of the waveguide channel structure. Typically, the top surfaces and bottom surfaces are metallized over their whole area. Likewise, the inner walls of the waveguide channel structure is metalized. The metallization may be made of a high-conductive metal, e. g. copper or silver. Alternatively, some or all layers may be made from metal, e. g. brass.

A waveguide channel structure inside the antenna 1 (not visible in FIG. 1) opens into a plurality of waveguide openings 100 in the antenna top surface 1*a*. The antenna top surface 1*a* is, at the same time, the top surface of the top layer 10. The waveguide openings 100 are arranged in a regular matrix of rows and columns. As explained in more detail further below in context of FIG. 5, each waveguide opening 100 is associated with an end branch 111 (not visible in FIG. 1) of the waveguide channel structure in a one-to one relation.

Figure 2:
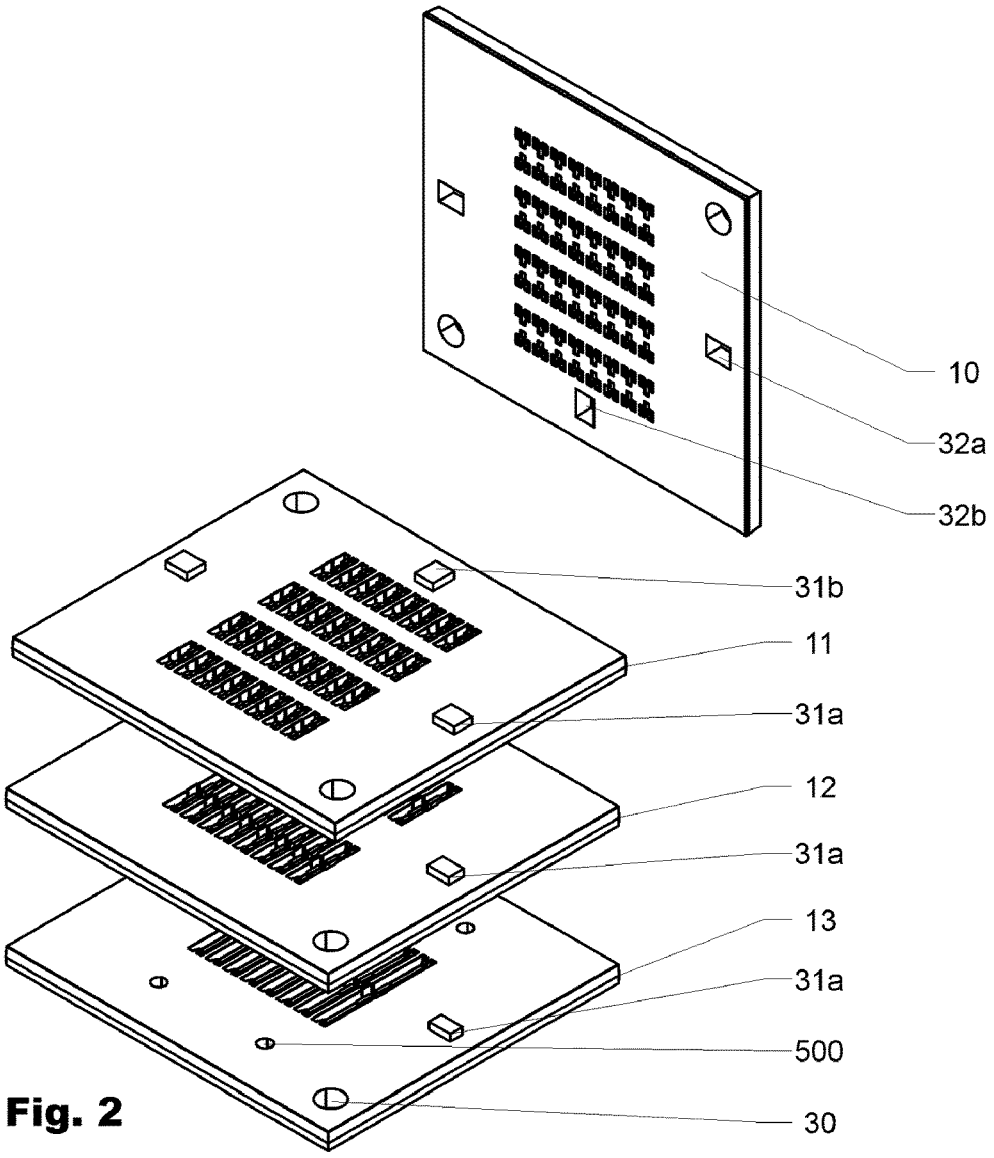
FIG. 2 shows the array antenna in an exploded view.

In the following, reference is additionally made to FIG. 2, showing the antenna assembly in perspective view with the single layers 10, 11, 12, 13, being spaced from each other along the z-direction, and the top layer 10 further being rotated for clarity reasons.

Figure 3:
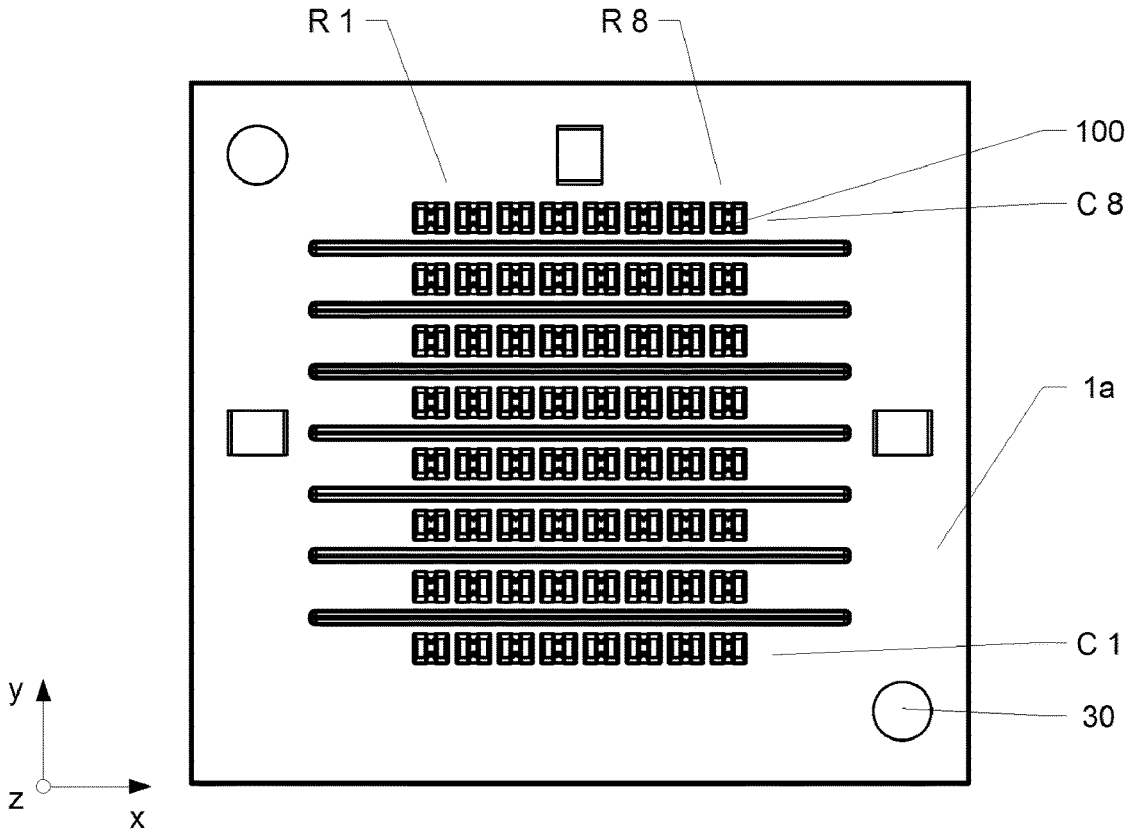
FIG. 3 shows a top view of the antenna top surface.

In the following, reference is additionally made to FIG. 3. FIG. 3 shows a top view of the antenna top surface 1*a*. By way of example, a total number of 64 waveguide openings 100 is present. The waveguide openings 100 are arranged in a regular matrix of exemplarily m=8 rows and n=8 columns. The rows are orientated vertically (extending in y-direction), with the leftmost row being referred to as row R1 and the rightmost row being referred to as row R8. The columns are oriented horizontally (extending in x-direction), with the uppermost row being referred to as column C8 and the lowermost column being referred to as column C1.

A recess in a form of an elongated channel 101 is present between pairs of neighbouring columns. For the exemplary number of eight columns, 7 channels are accordingly present. The length and arrangement of the channels 101 is such that the channels 101 symmetrically extend beyond the waveguide openings 100 in the outermost rows R1, R8, respectively.

Figure 4:
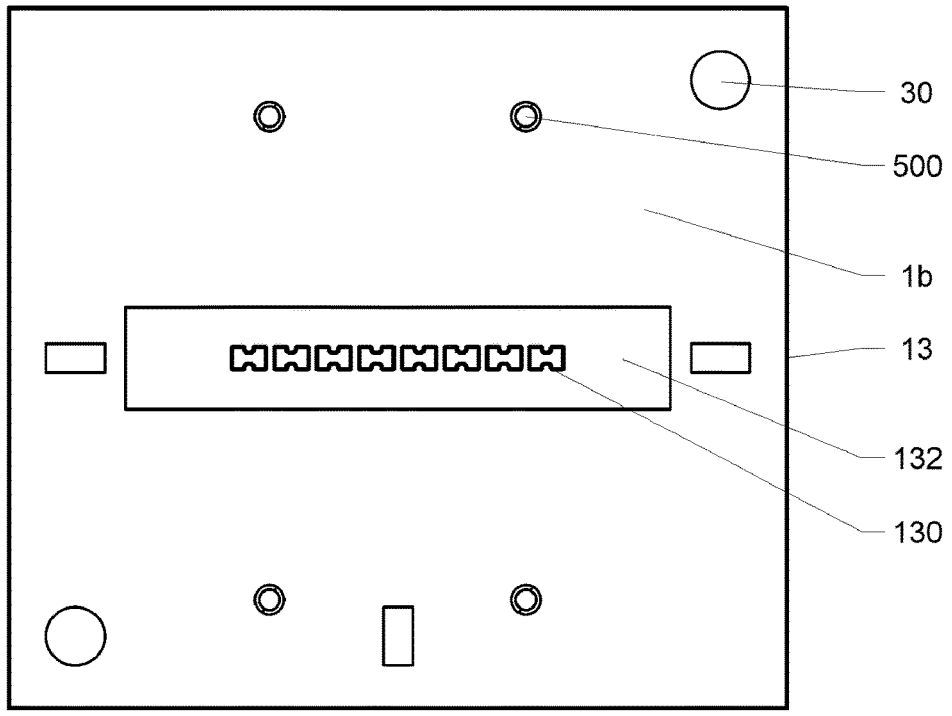
FIG. 4 shows a bottom view of the antenna bottom surface.

In the following, reference is additionally made to FIG. 4. FIG. 4 shows a bottom view of the antenna bottom surface 1*b* which is, at the same time the bottom surface of the bottom layer 13. The waveguide channel structure (not visible in FIG. 4) inside the antenna 1 opens into a plurality of exemplarily double ridged waveguide terminal openings 130 that are connected with the waveguide openings 100 via the waveguide channel structure. The waveguide terminal openings 130 are exemplarily arranged along a single column. A tin solder area 132 is provided around the waveguide terminal openings in order to provide mating surface to a further components, such establishing operative coupling to an RF circuit that is, e.g. arranged on a printed circuit board. This ridge could be used as surface for soldering the further components or only to increase the contact pressure between area around antenna waveguide terminal openings and further components, resulting in better galvanic connection in the case of solder-less connection, e.g. screwing between antenna and further components.

In the shown example, exemplarily cuboid-shaped alignment protrusions 31*a*, 31*b* project from the top surfaces of the bottom layer 13 and the intermediate layers 11, 12 in a triangular configuration. Two alignment protrusions 31*a* are arranged along a line parallel of an edge and spaced apart from each other as far as possible in order to minimize tolerance-caused alignment errors. In a state of proper alignment, the alignment protrusions 31*a* engage corresponding alignment openings 32*a* the bottom surface of the next upper layer in the stack. The alignment protrusions 31*a* and alignment openings 32*a* ensure alignment between the antenna layers 10, 11, 12, 13 along the first direction (x-direction). For alignment along the second direction (y-direction) perpendicular to the first direction, a third alignment protrusion 31*b* and a corresponding alignment opening 32*b* are provided on the top respectively bottom surfaces. Exemplarily the alignment protrusions 31*a*, 31*b* and the alignment openings 32*a*, 32*b* each form an isosceles triangle.

Exemplarily, two through-going alignment bores 30 are additionally provided in diagonal corners of all layers. In a state of correct mutual alignment of the layers, the alignment bores of all layers coincide, thus forming two through-going bores. In this example, the alignment bores 30 serve for process alignment during assembly via alignment pins (not shown) which are subsequently removed in order to avoid positioning redundancies. Alternatively, however, alignment bores and alignment pins may also be used for permanent alignment, while omitting the alignment projections 31*a*, 31*b*, and the alignment openings 32*a*, 32*b*. Such embodiment may especially be favourable for machined metal layers since the machining of the alignment protrusions 31*a*, 31*b* is time consuming and involves the cutting of a significant amount of material. In further variants, the alignment bores 30 are omitted. Alignment bores 30 and/or pairs of alignment protrusions 31*a*, 31*b*, and alignment openings 32*a*, 32*b* may also be used for aligning with further components, such as a printed circuit board (PCB).

By way of example, layers 10, 11, 12, 13 are mounted and connected together by means of soldering. The solder layers mechanically connect layers 10, 11, 12, 13 and further ensure galvanic coupling of the top and bottom surfaces of neighbouring layers via the metallic or metallized top and bottom surfaces. Alternatively or additionally to soldering the layers 10, 11, 12, 13, clamps, fixtures or the like may be used. Furthermore, the connection between the layers could be also done by means of screwing with screws having self-cutting thread inside plastic material or by screws with non-self-cutting threads, e. g. machine threads, and additional nuts may be used.

By the way of example, mechanic and galvanic connection with further components, in particular of the antenna bottom surface 1*b* with a printed circuit board (PCB), can be realized via exemplarily four screws (not shown) with self-cutting threads that cut into layers. For this purpose, corresponding holes 500 are present in the layers (visible for the bottom layer 13 in FIG. 2 and FIG. 4). Alternatively or additionally to screws, clamps, fixtures or the like may be used. Furthermore, screws with non-self-cutting threads, e. g. machine threads, and additional nuts may be used.

In the following, reference is additionally made to FIG. 5. Fig. shows a perspective cross sectional view if the antenna 1. It can be seen that the channels 101 extend from the antenna top surface 1*a* towards the antenna bottom surface 1*b*. The channels 101 extend fully inside the top layer 10.

The thickness of the top layer 10 is accordingly thicker than the depth of the channels 101 as measured from the antenna top surface 1*a* to the channel ground 102. The depth of the channels 100 is favourably between ⅛ and ⅜ of the wavelength of an operational frequency range of the antenna which may, e.g. be from 57 GHz to 66 GHz. The width of the channels 101 at the top surface 1*a* is larger than ⅛ wavelength in the mid-frequency of the operational frequency range of the antenna and favourably somewhat smaller at the channel ground 102. If the top layer 10 is made from metalized plastic, the metallization of the antenna top surface 1*a* extends into the channels 101 such that the inner side walls and the channel ground 102 are also metalized.

Figure 5:
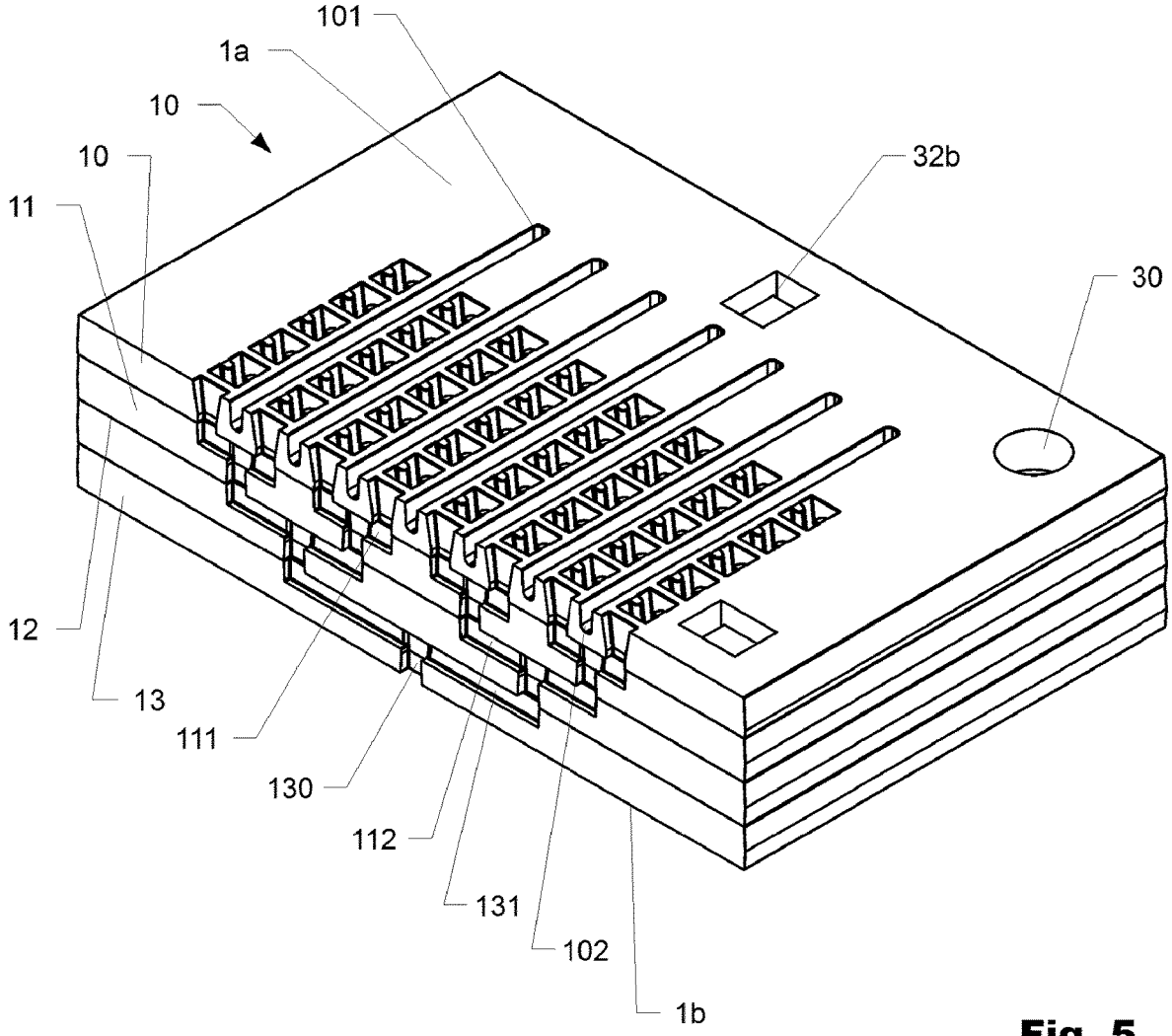
FIG. 5 shows the antenna in a perspective cut view.

FIG. 5 further illustrates the waveguide channel structure inside the antenna 1 for a single row. Starting from a waveguide terminal opening 130, the waveguide channel structure branches in the bottom layer 13 into two branches 131 in a symmetric way. In the following first intermediate layer 12, each of the branches 130 branches into two branches 121 in a symmetric way, resulting in a total number of four branches at the top of the first intermediate layer 12. In the following second intermediate layer 11, each of the branches 121 branches into two branches (waveguide end branches) 111 in a symmetric way, resulting in a number of eight branches (waveguide end branches) 111 at the top surface of the second intermediate layer 11, corresponding to the number of eight columns. The arrangement is such that an opening in a top surface of each layer is in alignment with a corresponding opening of a layer in the bottom surface of the next following layer, thus ensuring smooth signal transition. The symmetric design further ensures constant signal propagation time between the waveguide terminal opening 100 and each of the waveguide openings 100 in all columns for associated row. The structure as shown in FIG. 5 is repeated independently for each row.

In a further embodiment, the channels 101 are replaced by non-metalized stripes on the generally metalized antenna top surface 1*a* (identical with the top surface of the top layer 10). Otherwise the design and in particular the top view (FIG. 3) and the bottom view (FIG. 4) may be the same as in the embodiment of FIG. 1 to FIG. 5, with ref. 101 indicating the non-metalized stripes.

In the following, reference is additionally made to FIG. 6 to FIG. 9, each showing a further embodiment of an antenna 1 in accordance with the present disclosure in a detailed top surface view. It is noted that the view of FIG. 6 to FIG. 9 is, rotated by 90 degrees as compared to FIGS. 3, 4. That is, the rows (indicated by "R") extend horizontally and the columns (indicated by "C") extend vertically on the drawings. Where not stated differently, the design is generally identical to the embodiment of FIG. 1 to FIG. 4. In each of FIG. 6 to FIG. 9, three rows and two columns are shown.

Figure 6:
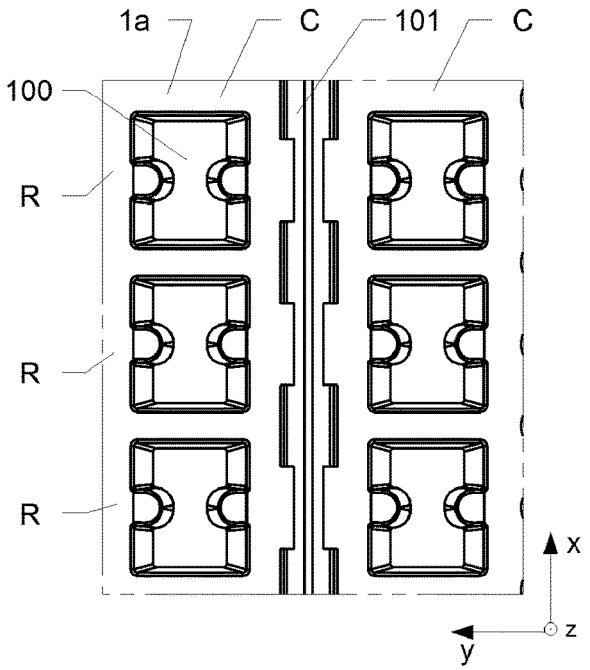
FIG. 6 shows a further embodiments of an array antenna in a top surface view (detail)
Figure 7:
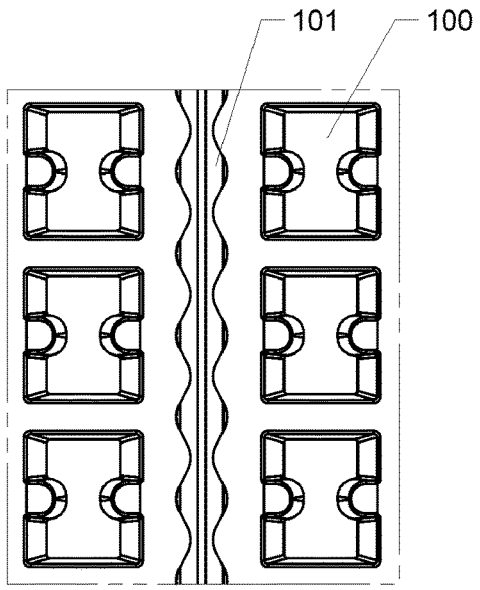
FIG. 7 shows a further embodiments of an array antenna in a top surface view (detail)
Figure 8:
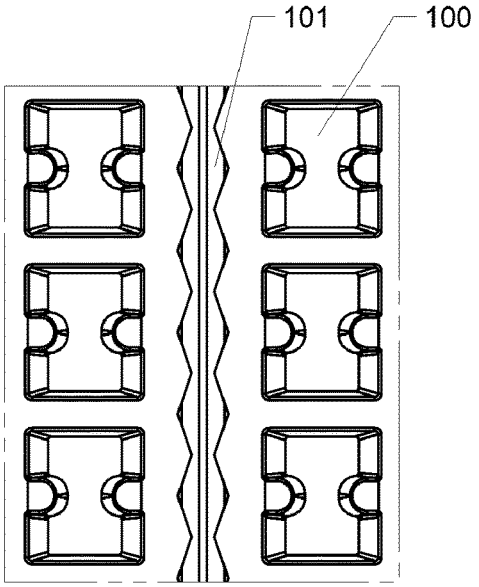
FIG. 8 shows a further embodiments of an array antenna in a top surface view (detail)

In each of FIG. 6 to FIG. 8, the width of the channels 101 varies along the channel length. In FIG. 6, the channel width periodically varies between two different widths in discrete steps. In FIG. 7, the channel widths varies periodically with a sine, while it varies in a symmetric zig-sag-line in FIG. 8. Exemplary, the design of the channels 101 is such that the channel is wide respectively wider between the rows of waveguide openings 100 and narrow respectively narrowest in the centre lines of the rows. Other relative alignments, however, are also possible.

Figure 9:
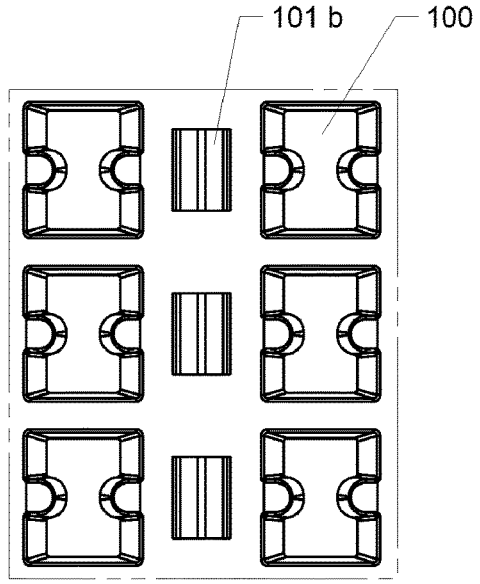
FIG. 9 shows a further embodiments of an array antenna in a top surface view (detail)

The embodiment of FIG. 9 is different from all before-described embodiments in so far as the recesses are not provided as elongated channels for this embodiment. Instead, a separate recess in form of a depression 101*b* is provided in the top layer 10 in each row and between neighbouring columns. In each row, the depressions 101*b* are aligned with the waveguide openings 100 of this row. For an arrangement with n rows and m columns of waveguide openings 100, a total number of n×(m−1) depressions 101*b* is accordingly present between the waveguide openings 100. While not visible in the detailed view of FIG. 9, further somewhat elongated depressions may additionally be present that extend beyond the outermost rows. Such additional depressions favourably enhance the reduction of mutual coupling.

Figure 10:
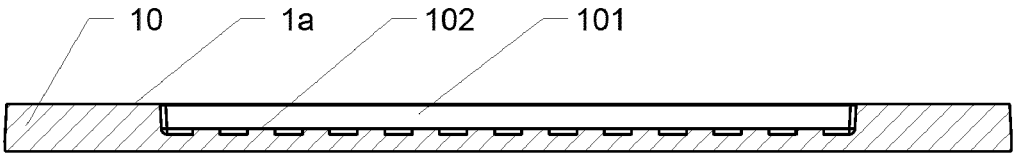
FIG. 10 shows a further embodiments of an array antenna in a cross-sectional view (detail)
Figure 11:
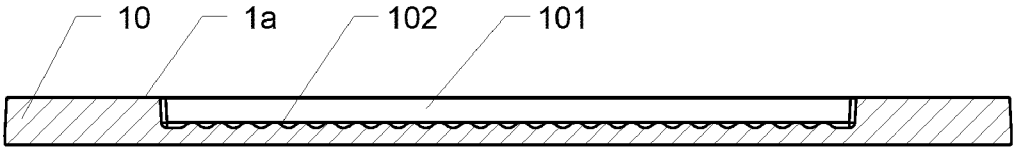
FIG. 11 shows a further embodiments of an array antenna in a cross-sectional view (detail)
Figure 12:
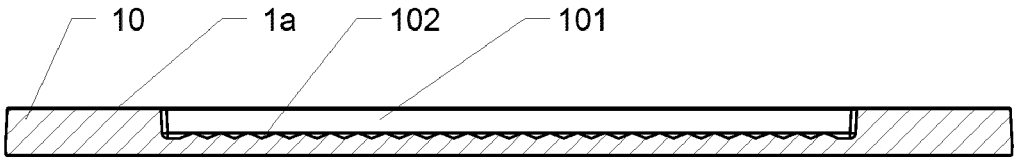
FIG. 12 shows a further embodiments of an array antenna in a cross-sectional view (detail)

In the following, reference is additionally made to FIG. 10 to FIG. 12, each showing a further embodiment of an antenna 1 in accordance with the present disclosure in a cross sectional view of the top plate 10 along a channel 101. The embodiment of FIG. 10 to FIG. 6 are similar to the embodiment of FIG. 1 to FIG. 5 in most aspects and in particular have, like the embodiment of FIG. 1 to FIG. 5, a channel 101 between and parallel to neighbouring columns of waveguide openings 100. In each of FIG. 10 to FIG. 12, the channel depth varies, in contrast to the embodiment of FIG. 1 to FIG. 5, along the channel length, such that the channel ground 102 has a varying distance from the antenna top surface 1*a* along the channel length.

In FIG. 10, the channel depth periodically varies between two different depths in discrete steps. In FIG. 11, the channel depth varies periodically with a sine, while it varies in a symmetric zig-sag-line in FIG. 12. It is noted that the embodiments of FIG. 10 to FIG. 12 are similar to the embodiments of FIG. 6 to FIG. 8, with the major difference that the channel width varies in FIG. 6 to FIG. 8 while the channel depth varies in FIG. 10 to FIG. 12.

Figure 13:
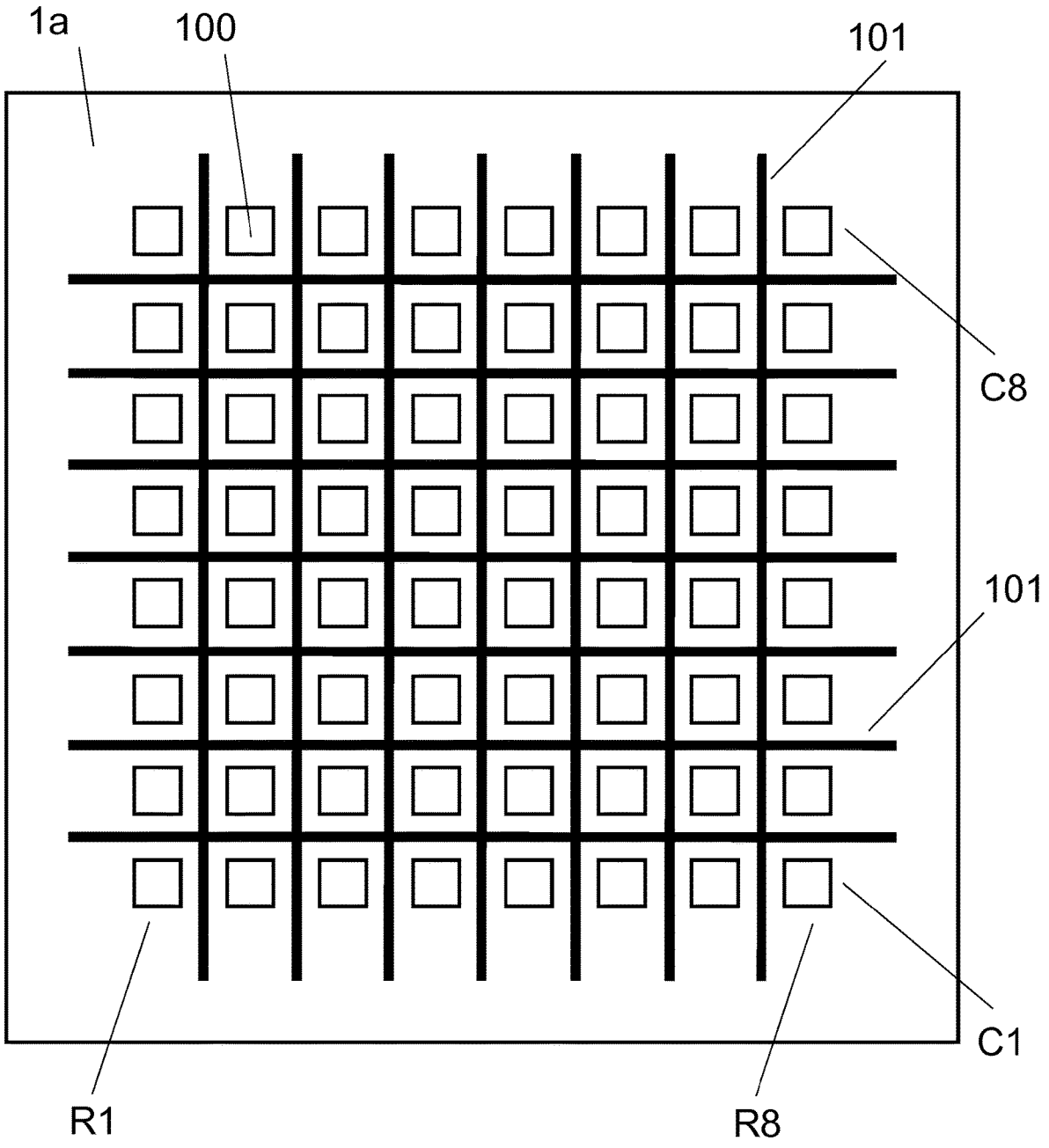
FIG. 13 shows a further embodiment of an array antenna in a schematic view of the antenna top surface.

In the following, reference is additionally made to FIG. 13, showing a further exemplary embodiment of an antenna 1 in accordance with the present disclosure in a schematic view of the antenna top surface 1*a*. In most aspects, the embodiment of FIG. 13 is similar to the before-discussed embodiment of FIG. 1 to FIG. 5. In particular, elongated channels 101 are arranged between and parallel to pairs of neighbouring columns. In FIG. 13, however, elongated channels 101 are additionally arranged between and parallel to pairs of neighbouring rows. For the n rows and m columns, the channels 101 accordingly form a (m−1)×(n−1) grid.

Figure 14:
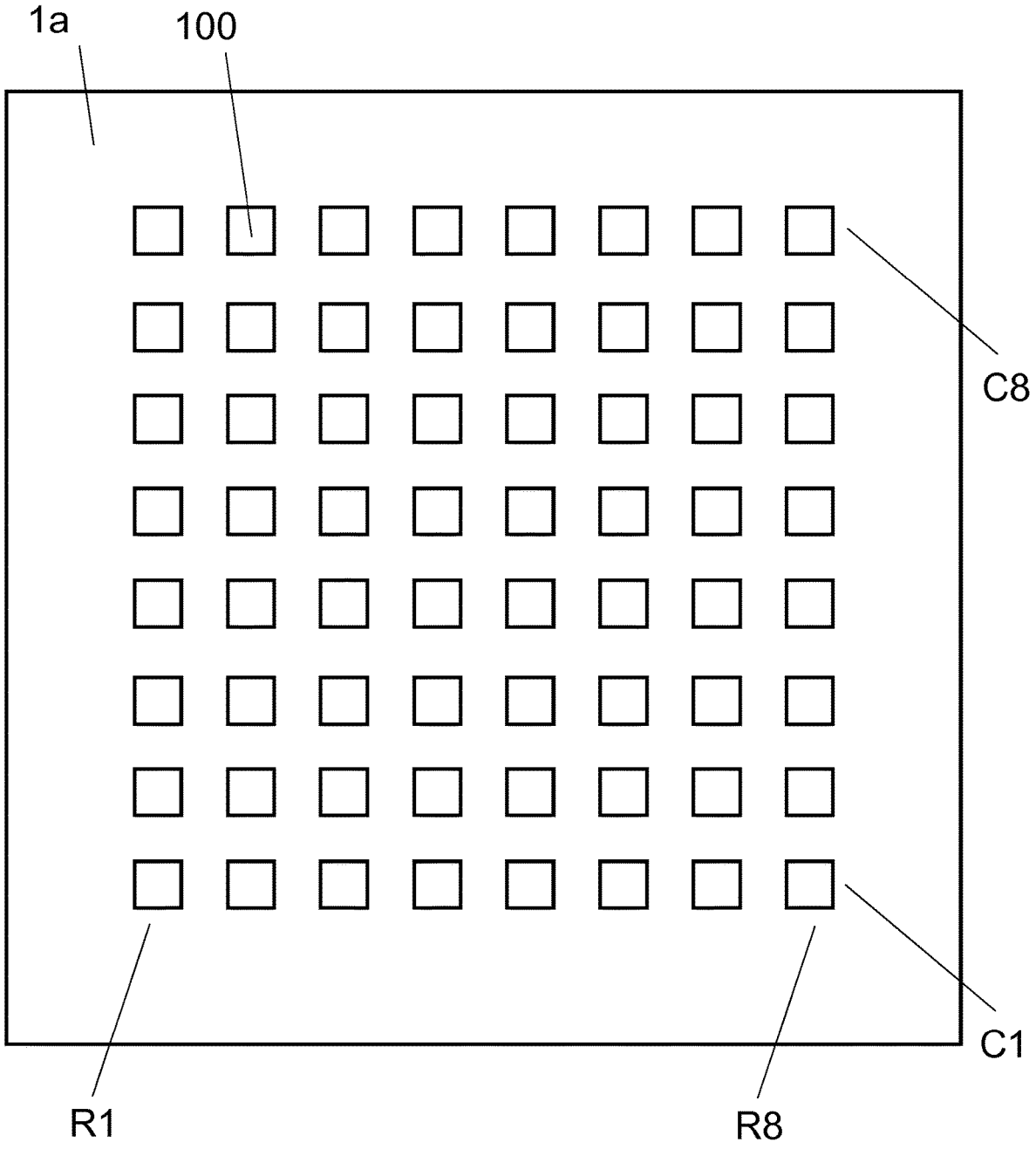
FIG. 14 shows a further embodiment of an array antenna in a schematic view of the antenna top surface.

In the following, reference is additionally made to FIG. 14, showing a further exemplary embodiment of an antenna 1 in accordance with the present disclosure in a schematic view of the antenna top surface 1*a*. In most aspects, the embodiment of FIG. 13 is similar to the before-discussed embodiment of FIG. 1 to FIG. 5. In contrast, however, the antenna top surface 1*a* (identical with the top surface of the top layer 10) is fully non-metalized and no recesses are present between the waveguide openings 100.

The invention claimed is:

1. An antenna comprising:

an antenna top surface (1*a*) and an antenna bottom surface (1*b*), wherein the antenna includes a waveguide channel structure with a plurality of waveguide end branches (111), wherein each waveguide end branch (111) opens into an associated waveguide opening (100) in the antenna top surface (1*a*) in a one-to-one relation, wherein the waveguide openings (100) are arranged in a pattern of rows and columns, and wherein a plurality of recesses (101, 101*b*) extend from the antenna top surface (1*a*) towards the antenna bottom surface (1*b*), the plurality of recesses (101, 101*b*) being arranged such that a recess (101, 101*b*) is present between pairs of neighbouring waveguide openings (100) of the same row and/or column;

wherein the waveguide channel structure opens into a plurality of waveguide terminal openings (130) in the antenna bottom surface (1*b*) and the waveguide channel structure extends between the antenna top surface (1*a*) and the antenna bottom surface (1*b*), the waveguide channel structure coupling the waveguide openings (100) and the waveguide terminal openings (130); and wherein the number of waveguide terminal openings (130) corresponds to the number of rows and wherein the waveguide channel structure couples each waveguide terminal opening (130) with all waveguide openings (100) of a corresponding row and independent from the other rows.

2. The antenna according to claim 1, wherein the recesses are elongated channels (101) that extend traverse to the rows and/or columns.

3. The antenna according to claim 2, wherein the channels (101) extend beyond outermost rows and/or columns.

4. The antenna according to claim 2, wherein a channel depth varies periodically along the channel length.

5. The antenna according to claim 2, wherein a channel width varies periodically along the channel length.

6. The antenna according to claim 1, wherein a separate recess (101*b*) is provided in each row between neighbouring columns and/or in each column between neighbouring rows.

7. The antenna according to claim 1, wherein a recess depth is between ⅛ and ⅜ of the wavelength in an operational frequency range of the antenna.

8. The antenna according to claim 1, wherein the antenna is made from stacked coplanar layers (10, 11, 12, 13), with the antenna top surface (1*a*) belonging to a top layer (10) and the antenna bottom surface (1*b*) belonging to the bottom layer (13).

9. The antenna according to claim 1, wherein the antenna is made from metal and/or metalized plastics and/or conductive plastics.

10. The antenna of claim 1 comprising an array antenna.

11. An antenna comprising:

an antenna top surface (1*a*) and an antenna bottom surface (1*b*), wherein the antenna includes a waveguide channel structure that opens into a plurality of waveguide openings (100) in the antenna top surface (1*a*), the waveguide openings (100) being arranged in a pattern of rows and columns, wherein the antenna includes a top layer (10) with the antenna top surface (1*a*) belonging to the top layer (10), wherein the top layer (10) is made from partially metallized non-conductive material, and a non-metalized area is present on the antenna top surface (1*a*) between neighbouring waveguide openings (100) of the same row and/or column;

wherein the waveguide channel structure opens into a plurality of waveguide terminal openings (130) in the antenna bottom surface (1*b*) and the waveguide channel structure extends between the antenna top surface (1*a*) and the antenna bottom surface (1*b*), the waveguide channel structure coupling the waveguide openings (100) and the waveguide terminal openings (130); and wherein the number of waveguide terminal openings (130) corresponds to the number of rows and wherein the waveguide channel structure couples each waveguide terminal opening (130) with all waveguide openings (100) of a corresponding row and independent from the other rows.

12. The antenna according to claim 11, wherein the top surface is metalized in an area around the waveguide openings (100) and a plurality of non-metalized stripes are present on the antenna top surface (1*a*) such that a non-metalized strip extends between neighbouring rows and/or columns.

13. The antenna according to claim 11, wherein the antenna top surface (1*a*) is non-metalized over a whole area that is covered by the waveguide openings (100).

14. The antenna of claim 11 comprising an array antenna.

* * * * *